US011725371B2

(12) United States Patent
Tyler

(10) Patent No.: US 11,725,371 B2
(45) Date of Patent: Aug. 15, 2023

(54) SINK BASIN DRAIN ASSEMBLY

(71) Applicant: V-T Industries Inc., Holstein, IA (US)

(72) Inventor: Joel D. Tyler, Cushing, IA (US)

(73) Assignee: V-T Industries Inc., Holstein, IA (US)

( * ) Notice: Subject to any disclaimer, the term of this patent is extended or adjusted under 35 U.S.C. 154(b) by 0 days.

(21) Appl. No.: 17/704,270

(22) Filed: Mar. 25, 2022

(65) Prior Publication Data

US 2022/0307249 A1 Sep. 29, 2022

Related U.S. Application Data

(60) Provisional application No. 63/166,022, filed on Mar. 25, 2021.

(51) Int. Cl.
*E03C 1/182* (2006.01)
*E03C 1/264* (2006.01)

(52) U.S. Cl.
CPC ..... *E03C 1/182* (2013.01); *E03C 1/264* (2013.01)

(58) Field of Classification Search
CPC . E03C 1/182; E03C 1/264; E03C 1/18; E03C 1/28
USPC ..... 4/689
See application file for complete search history.

(56) References Cited

U.S. PATENT DOCUMENTS 2,107,126 A * 2/1938 Pasman ..... E03C 1/264 4/291
2,278,566 A 4/1942 Schaible
3,007,179 A * 11/1961 Bertulli ..... E03C 1/264 4/619
3,281,869 A * 11/1966 Schweigaard-Olsen ..... E03C 1/264 210/166
4,042,983 A * 8/1977 Carpentier ..... E03C 1/22 4/291
5,269,027 A * 12/1993 Iatropoulos ..... E03C 1/306 285/12
5,318,230 A 6/1994 Ferguson et al.
(Continued)

FOREIGN PATENT DOCUMENTS

CN 106284451 A 1/2017
KR 100557480 B1 3/2006

OTHER PUBLICATIONS

International Search Report and Written Opinion for PCT Application No. PCT/US2022/021871, dated Jul. 27, 2022.

*Primary Examiner* — Benjamin R Shaw
(74) *Attorney, Agent, or Firm* — Ryan T. Grace; Advent, LLP

(57) ABSTRACT

Systems and methods for providing a sink basin having a coupled drain assembly for interchangeably coupling a drain and a garbage disposal are described. In an aspect, a sink basin drain assembly includes, but is not limited to, a drain body defining an interior; a collar extending outwardly from the drain body and terminating at an exterior edge and tapering from the exterior edge to an aperture fluidically coupled with the interior, the exterior edge configured to couple with an inwardly extending interior lip on a bottom portion of a flanged drain housing, the collar including a collar seal configured to abut an upper surface of the; and a drain shield including a base and sidewalls extending upwardly from the base, the sidewalls configured to interface with the bottom portion of the flanged drain housing to push the lip against the collar seal.

20 Claims, 5 Drawing Sheets

(56) References Cited

U.S. PATENT DOCUMENTS

| | | | | |
|---|---|---|---|---|
| 6,237,168 | B1 * | 5/2001 | Daniel, III | A47K 1/14 4/689 |
| 6,484,330 | B2 * | 11/2002 | Gray | E03C 1/2302 4/689 |
| 6,755,966 | B1 * | 6/2004 | Reed | E03F 5/0408 4/679 |
| 8,347,424 | B2 * | 1/2013 | Wroblewski | E04G 23/02 52/302.1 |
| 8,347,906 | B1 * | 1/2013 | Ismert | E04G 15/061 4/293 |
| 9,783,968 | B2 | 10/2017 | Childs et al. | |
| 10,519,637 | B2 | 12/2019 | Childs et al. | |
| 10,626,586 | B2 | 4/2020 | Childs et al. | |
| 11,053,671 | B2 | 7/2021 | Childs et al. | |
| 2012/0255117 | A1 * | 10/2012 | Childs | E03C 1/262 4/679 |
| 2018/0030702 | A1 * | 2/2018 | Childs | E03C 1/2306 |
| 2018/0112381 | A1 * | 4/2018 | Lin | E03C 1/262 |
| 2020/0248441 | A1 | 8/2020 | Childs et al. | |

* cited by examiner

SINK BASIN DRAIN ASSEMBLY

CROSS-REFERENCE TO RELATED APPLICATIONS

The present application claims the benefit under 35 U.S.C. § 119(e) of U.S. Provisional Application Ser. No. 63/166,022, entitled SINK BASIN DRAIN ASSEMBLY, filed Mar. 25, 2021. U.S. Provisional Application Ser. No. 63/166,022 is hereby incorporated by reference in its entirety.

BACKGROUND

Sink basins include drain assemblies to provide an outlet for water to flow into drainage or septic systems via pipe connections with the drain assemblies. The drain assemblies can include drain baskets including a strainer to prevent the passages of particulates or larger objects, which could pose a clogging risk for conduits downstream from the sink. Drain assemblies can couple with other sink fixtures or equipment, such as garbage disposals of varying designs.

SUMMARY

Systems and methods for providing a drain assembly for a sink basin that includes a drain adapter for interchangeably coupling with each of a garbage disposal system and a drain basket are described. In an aspect, a sink basin drain assembly includes, but is not limited to, a flanged drain housing for coupling to a sink basin and a drain adapter. The flanged drain housing includes a housing body configured to fit within the drain aperture, the housing body defining an interior through which water from the sink basin can pass, a flange extending outwardly from a top portion of the housing body to interface with an upper surface of the sink basin adjacent the drain aperture, and a lip extending inwardly from a bottom portion of the housing body. The drain adapter includes a drain body defining an interior through which water from the flanged drain housing can pass, a collar extending outwardly from the drain body and terminating at an exterior edge, the collar tapering from the exterior edge to an aperture fluidically coupled with the interior of the drain body, the exterior edge configured to couple with the lip of the flanged drain housing, the collar including a collar seal configured to abut an upper surface of the lip to prevent the passage of water between the collar and the flanged drain housing, and a drain shield including a base and sidewalls extending upwardly from the base, the base defining an opening configured to surround an exterior of the drain body, the sidewalls configured to interface with the bottom portion of the flanged drain housing to push the lip against the collar seal.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. In the figures, the use of the same reference numbers in different instances in the description and the figures may indicate similar or identical items.

DETAILED DESCRIPTION

Overview

Figure 1A:
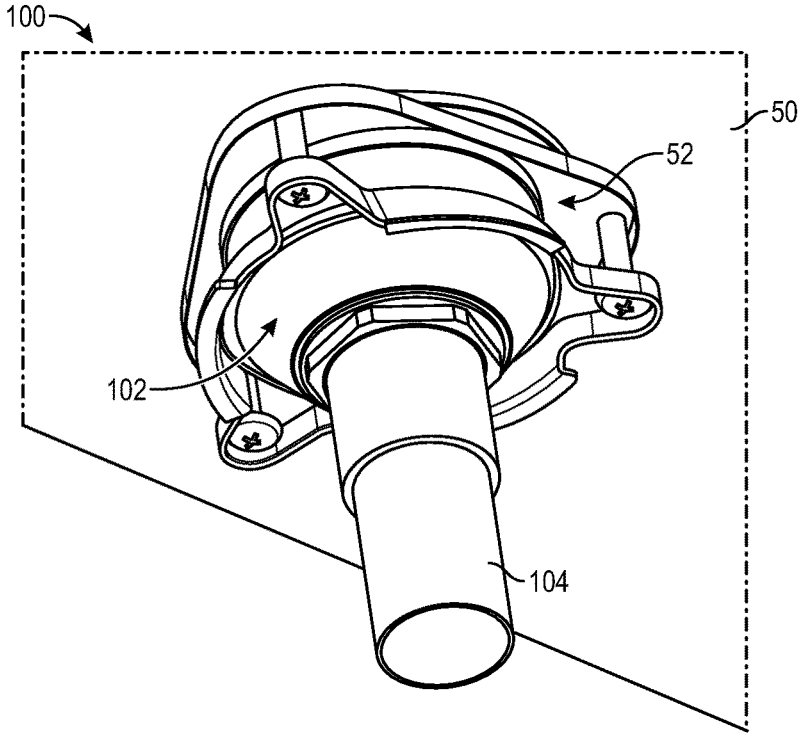
FIG. 1A is a bottom isometric view of a sink basin having a drain assembly with a drain adapter coupled with a drain basket and corresponding drainpipe in accordance with example embodiments of the present disclosure.
Figure 1B:
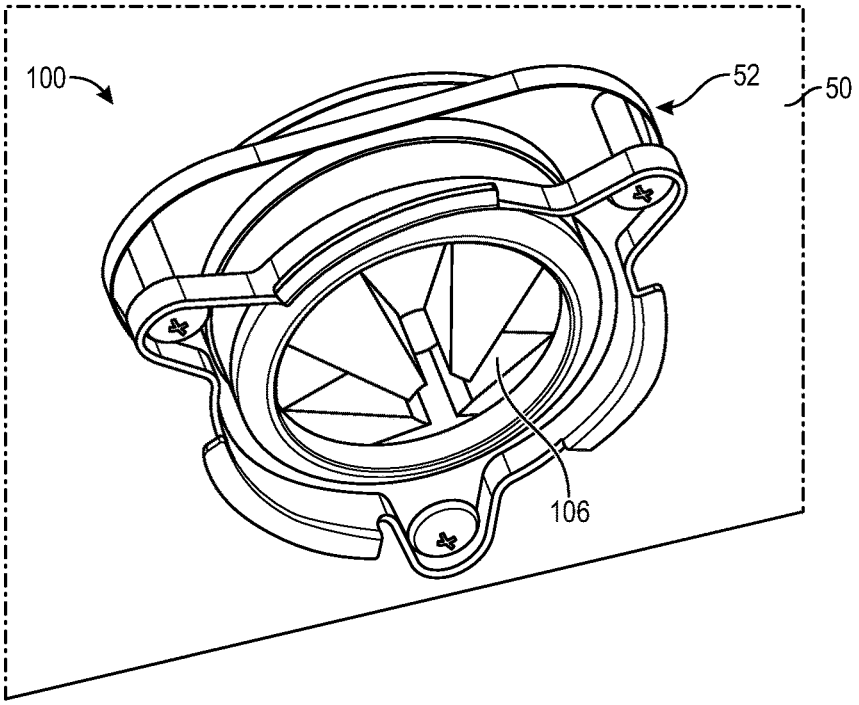
FIG. 1B is a bottom isometric view of a sink basin having the drain assembly of FIG. 1A with the drain adapter interchanged with a garbage disposal splash guard in accordance with example embodiments of the present disclosure.

Home and business renovations and modifications continue to be a popular source for do-it-yourself (DIY) projects. For example, homeowners can have a feeling of accomplishment in finishing home renovation projects on a DIY basis rather than hiring a contractor to perform the work. Kitchens, bathrooms, offices, home gyms, and other areas provide many opportunities to modify areas to include sinks or to upgrade existing sinks. However, sink installation frequently involves multiple back and forth visits to hardware stores or home improvement stores to overcome many of the challenges faced. For example, installation of a drain assembly between the sink basin and associated plumbing fixtures can pose multiple challenges, such as the potential for leaking water from the basin past misaligned plumbing features, selecting inappropriate fixtures based on whether a garbage disposal is present or is desired to be installed, misapplication of plumber's putty or other sealant, mess or waste associated with use of plumber's putty or other sealant, and the like.

Garbage disposal systems and installation or removal thereof can pose particular issues for DIY projects. Garbage disposals typically include inlet ports that are larger than drainpipes used to connect the sink with municipal sewer systems, local septic systems, or other drainage. The larger inlet ports facilitate handling of relatively large food waste for subsequent grinding, shredding, or pulverizing into particles that can flow through the drainpipes to minimize the risk of clogging the downstream piping. The inlet ports for the garbage disposal systems can be coupled with a drain in the sink basin having an opening substantially similar to the inlet port of the garbage disposal system to provide clearance for the food waste. If a garbage disposal is to be removed as part of a DIY project, the drain in the sink basin frequently provides openings too large for direct coupling with downstream drainpipes, requiring changes to the drain in the sink basin or trips to the hardware store for plumbing fixtures to accommodate the change. Similarly, if a garbage disposal is to be added as part of a DIY project, the drain in the sink basin frequently provides openings too small for the intake of the garbage disposal, or does not include connections suitable for coupling the garbage disposal to the drain, requiring changes to the drain in the sink basin or trips to the hardware store for plumbing fixtures to accommodate the change.

Accordingly, the present disclosure is directed, at least in part, to systems and methods for providing a sink basin with a drain assembly configured for interchangeable coupling with each of a garbage disposal system and a drain basket. The drain assembly includes a drain adapter that couples to a flanged drain housing extending through a drain hole in the sink basin. The drain adapter includes a drain body defining an interior through which water can flow from the flanged drain housing to a downstream drainpipe. The drain body includes a collar at a top portion that seats within a bottom portion of the flanged drain housing, supported by a lip formed in the flanged drain housing. The collar forms an aperture aligned with the interior of the drain body to direct water through the collar and into the interior of the drain body. In an aspect, the collar extends outwardly from the drain body at an angle to taper from an outer edge of the collar to the aperture to direct water from an upper surface of the collar towards the aperture and into the interior of the drain body. The drain adapter can include a seal positioned between the collar and the lip formed in the flanged drain housing to prevent passage of water therebetween and directing water through the aperture of the collar and the interior of the drain adapter.

The drain adapter includes a drain shield including an upper region configured to couple with an outer surface of the bottom portion of the flanged drain housing with a shield sidewall tapering inward to house at least a portion of the collar in an interior region of the drain shield. In an aspect, the drain shield includes a shelf connected to the shield sidewall at a lower region of the drain shield. The shelf can abut a flanged lock nut or other plumbing fixture that can push the drain shield upwards and into contact against the bottom portion of the flanged drain housing to provide a substantially waterproof seal. In an aspect, the drain body includes threading on an exterior surface to interface with threading of the flanged lock nut or other plumbing fixture. In an aspect, the drain body forms a drain basket housing in an interior region to secure a drain basket relative to the flanged drain housing. In an aspect, the drain assembly can be mounted to the sink basin without use of a putty product or fluid sealant.

The drain adapter can be installed into and removed from the flanged drain housing without requiring removal of a garbage disposal mount or associated mounting ring positioned about the exterior of the flanged drain housing to facilitate interchangeable mounting of the drain adapter and a garbage disposal unit in a convenient manner (e.g., without sourcing additional pipe connections, garbage disposal mount removal, etc.) suitable for DIY projects.

Example Implementations

Referring to FIGS. 1A-8, a sink basin drain assembly (referred to herein as "drain assembly 100") is shown in accordance with example implementations. The drain assembly 100 is shown in FIG. 1A as including a drain adapter 102 coupled with a drainpipe 104 and in FIG. 1B with the drain adapter 102 interchanged with a garbage disposal splash guard 106, each coupled with a sink basin 50 with a garbage disposal mount 52 in proximity thereto. The drain assembly 100 is shown in FIG. 1A with the drain adapter 102 which can support a drain basket, such as for use with a sink without a garbage disposal, whereas the drain assembly 100 is shown in FIG. 1B supporting the garbage disposal splash guard 106 without a drain basket for use with a sink portion having an accompanying garbage disposal unit (not shown). As described herein, the drain assembly 100 supports interchanging of the drain adapter 102 for use of the drain assembly 100 without a garbage disposal present (e.g., with the presence of the drain adapter 102) and with a garbage disposal present (e.g., with the absence of the drain adapter 102, through interchanging of the drain adapter 102 with the garbage disposal splash guard 106). While the sink basin 50 is shown with a single drain assembly 100 in each of FIGS. 1A and 1B, it can be appreciated that the sink basin 50 can support a single drain assembly (e.g., either the drain assembly 100 with the drain adapter 102 or the drain assembly 100 without the drain adapter 102), more than two drain assemblies 100, a plurality of drain assemblies in the same configuration (e.g., up to multiple drain assemblies 100 having the drain adapter 102, up to multiple drain assemblies 100 without the drain adapter 102, and combinations thereof), or the like.

Figure 2:
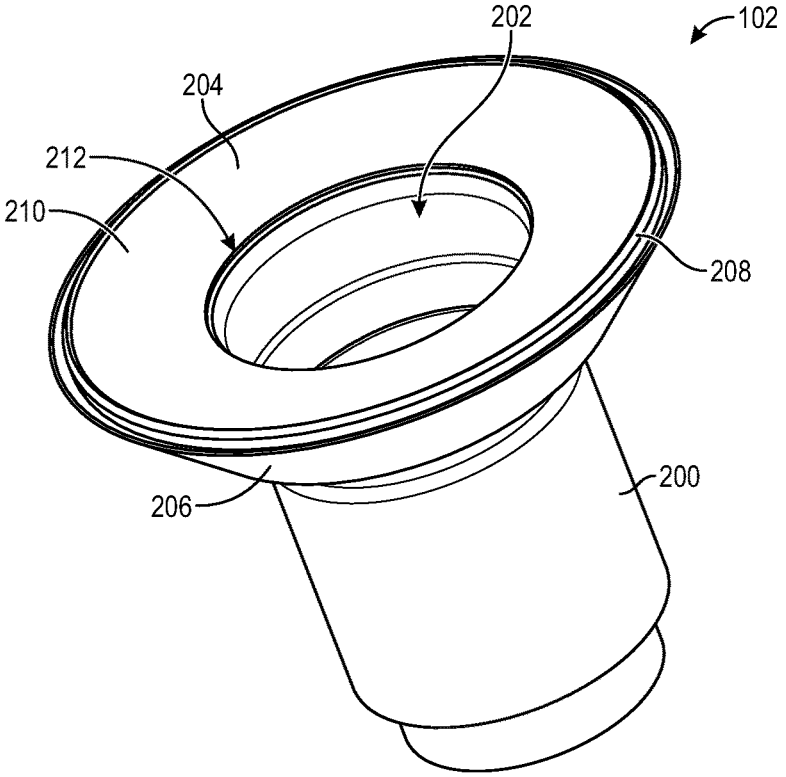
FIG. 2 is an isometric view of the drain adapter of FIG. 1A.
Figure 3:
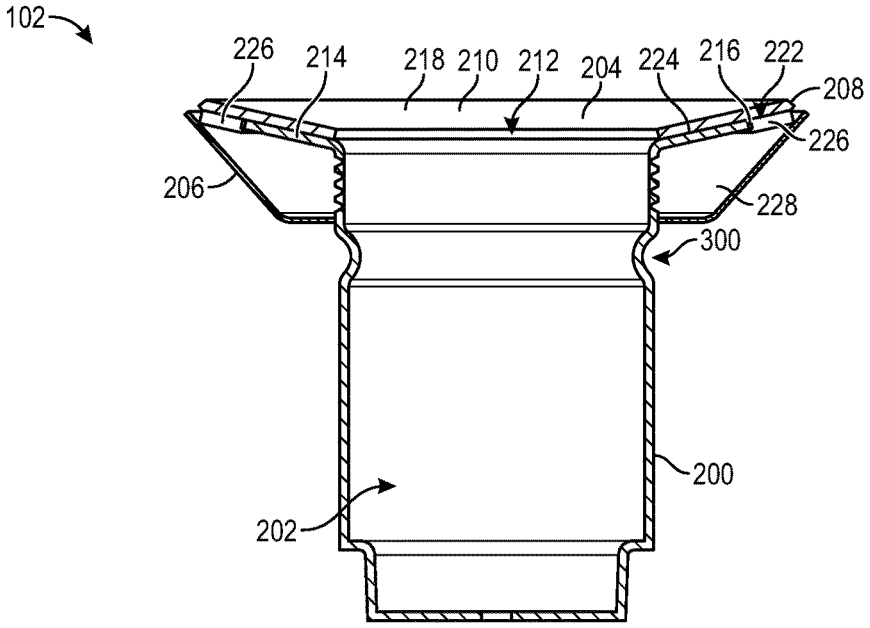
FIG. 3 is a cross-sectional view of the drain adapter of FIG. 2.
Figure 4:
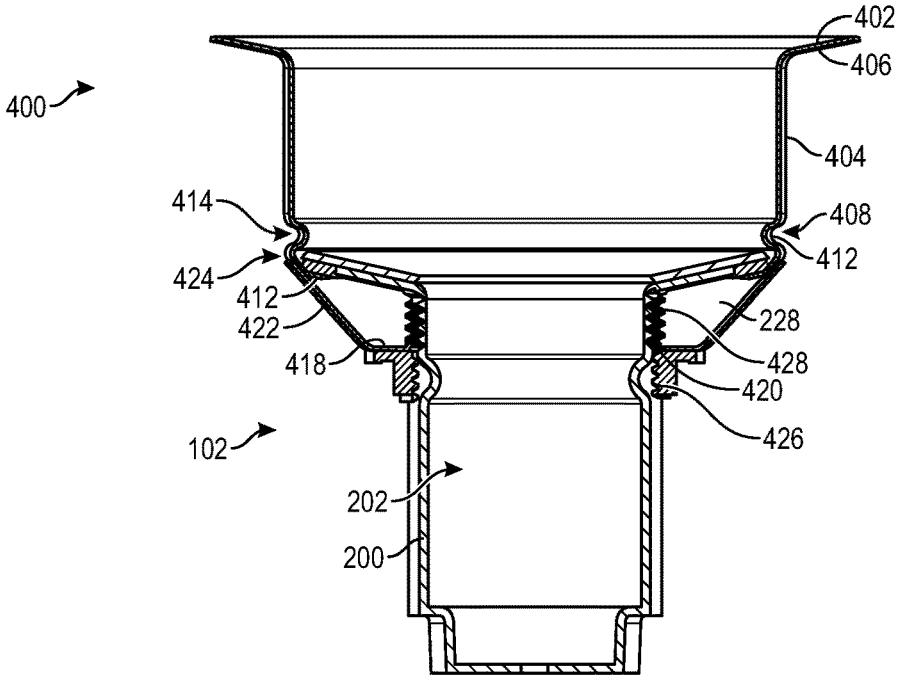
FIG. 4 is a cross-sectional view of the drain adapter of FIG. 2 coupled with a flanged drain housing in accordance with example embodiments of the present disclosure.

The drain adapter 102 is shown in FIGS. 2 and 3 as generally including a drain body 200 defining an interior 202, a collar 204 extending outwardly from the drain body 200, and a drain shield 206 beneath the collar and extending outwardly from the drain body 200. The drain body 200 is shown as having a generally cylindrical shape. The collar 204 includes a top portion 210 defining an aperture 212 that aligns with the interior 202 of the drain body 200 and that extends outwardly from the drain body 200 terminating in an exterior edge 208. The collar 204 can also include a bottom portion 214 that supports at least a portion of the top portion 210 (e.g., on an upper surface of the bottom portion 214) and extends from the drain body 200 terminating in an exterior edge 216. In general, the collar is sized and arranged such that the aperture 212 and the interior 202 provide substantially unimpeded access of water impacting the collar 204 to flow into the interior 202. For example, the collar 204 can extend outwardly from the drain body 200 at an angle to taper from the exterior edge 208 of the collar 204 to the aperture 212 to direct water from an upper surface of the collar 204 (e.g., an upper surface 218 of the top portion 210) towards the aperture 212 and into the interior 202 of the drain body 200. In implementations, one or more of the top portion 210 and the bottom portion 214 are formed in a substantially frustoconical shape. In implementations, the aperture 212 has a larger diameter than an entry region 220 of the interior 202 such that the collar 204 does not block any portion of the opening into the interior 202 as water descends from the collar 204 into the interior 202. The top portion 210 and the bottom portion 214 can be coupled together with an adhesive, weld, or the like, however the disclosure is not limited to forming separate portions. For instance, the top portion 210 and the bottom portion 214 can be formed as a single structure for introduction and attachment to the drain body 200, can be formed as a single structure formed with the drain body 200, or another structural configuration.

In implementations, the exterior edge 208 of the top portion 210 of the collar 204 extends beyond the exterior edge 216 of the bottom portion 214 defining a gap 222 on a bottom surface 224 of the top portion 210 adjacent the exterior edge 216. The gap 222 is configured to facilitate introduction of a seal into the drain adapter 102. For example, the collar 204 is shown including a collar seal 226 extending outwardly from the exterior edge 216 of the bottom portion 214. The collar seal 226 can be formed from a variety of pliable materials suitable to prevent the passage of water including, but not limited to, foam, rubber, plastic, or the like. The collar seal 224 is positioned adjacent an interior surface 228 of the drain shield 206 to facilitate the prevention of water from flowing past the collar 204 when the collar 204 is installed in a flanged drain housing, as described further with reference to FIGS. 4-7.

Referring to FIGS. 4-7, the drain adapter 102 is shown coupled to a flanged drain housing 400 that is configured to couple to the sink basin 50 to secure the drain assembly 100 relative to the sink basin 50. For instance, a portion of the flanged drain housing 400 is shown (e.g., in FIGS. 5 and 6) passing through a drain opening 54 formed in the sink basin 50. The flanged drain housing 400 includes a flange 402 extending outwardly from a top portion of the housing body 404 to interface with an upper surface 56 of the sink basin 50. The flange 402 can include a seal, coating, or other material on a bottom surface 406 that interfaces with the upper surface 56 of the sink basin 50 to prevent the passage of water between the flanged drain housing 400 and the sink basin 50 while allowing the water to flow through the housing body 404 and into the drain adapter 102. In implementations, the flange 402 includes a seal or coating on the bottom surface 406 that interfaces with the upper surface 56 of the sink basin 50 without use of an intervening plumber's putty or fluid sealant.

The flanged drain housing 400 is shown including a recessed portion 408 in the housing body 404 beneath the flange 402. The recessed portion 408 can support a mounting ring 410 on an exterior surface of the housing body 404 within the recessed portion 408. The mounting ring 410 facilitates installation of the garbage disposal mount 52 about the drain assembly 100. For instance, the mounting ring 410, when installed in the recessed portion 408, can abut a bottom mounting bracket 58 of the garbage disposal mount 52. The bottom mounting bracket 58 can be coupled to an upper mounting bracket 60 via one or more fasteners 62. The fasteners 62 can push the upper mounting bracket 60 towards the sink basin 50 where intervening seals can assist with preventing the passage of water between the flanged drain housing 400 and the sink basin 50. For example, the garbage disposal mount 52 is shown with the upper mounting bracket 60 supporting a first seal 64 and a second seal 66 stacked on the first seal 64. In implementations, the first seal 64 is a fiber gasket (e.g., a cardboard material) which supports a rubber gasket as the second seal 66. As the fastener 62 pushes the upper mounting bracket 60 towards the sink basin 50, the mounting ring 410 supports the bottom mounting bracket 58 to allow the upper mounting bracket 60 to push the first seal 64 and second seal 66 into contact with a bottom surface 68 of the sink basin 50 to provide a watertight barrier between housing body 404 and the sink basin 50 at the drain opening 54.

The collar 204 of the drain adapter 102 fits within the housing body 404 to provide an interface between the flanged drain housing 400 and the drainpipe 104 to permit water to flow from the sink basin 50 and into the drainpipe 104 through the drain adapter 102. For example, the housing body 404 can define a lip 412 that extends inwardly from the housing body 404. In implementations, the lip 412 is positioned beneath the recessed portion 408 at a bottom portion 414 of the housing body 404. The collar 204 can be inserted into the drain adapter 102 such that the collars 204 rests on an upper surface 416 of the lip 412 (e.g., shown in FIG. 7) to support the drain adapter 102 with respect to the flanged drain housing 400. For example, in implementations, the collar seal 226 abuts the upper surface 416 of the lip 412 and is positioned between the top portion 210 of the collar 204 and the lip 412 to prevent the passage of water between the flanged drain housing 400 and the collar 204, where the water is directed into the aperture 212 for passage into the interior 202 of the drain body 200.

Figure 5:
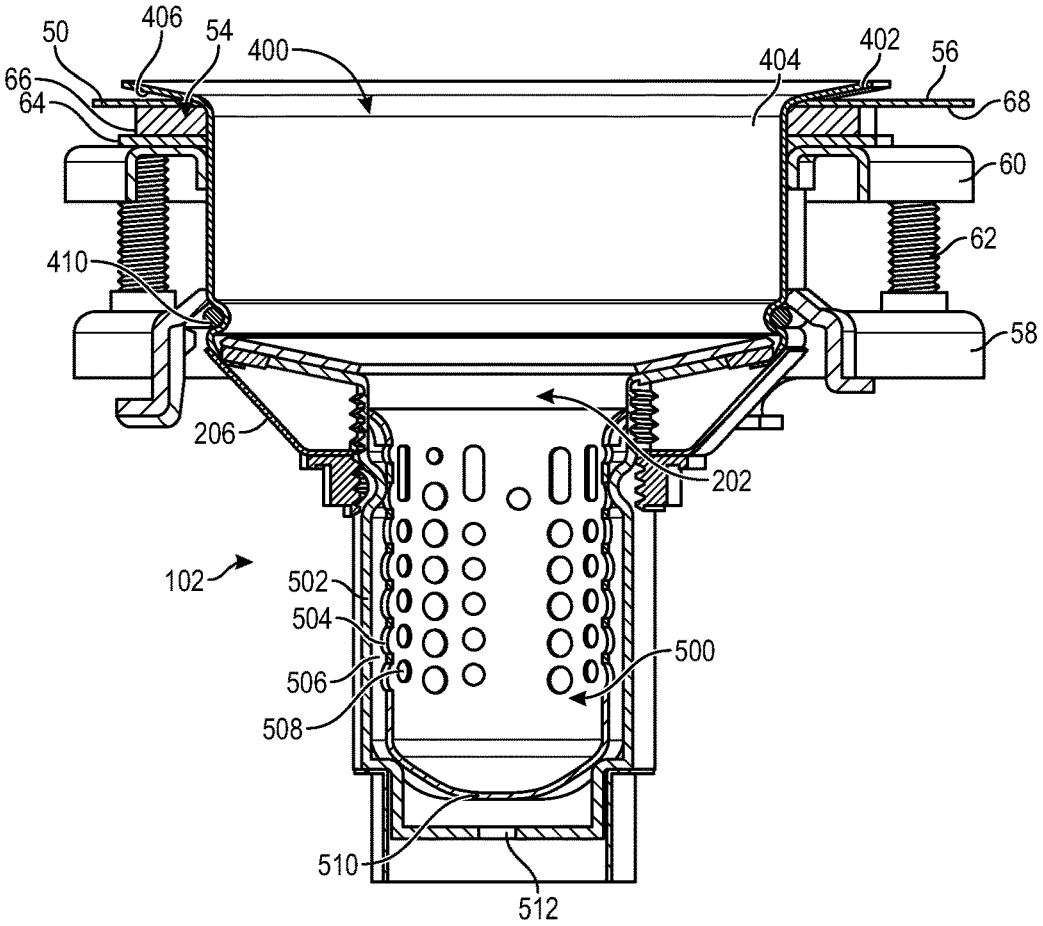
FIG. 5 is a cross-sectional view of the drain adapter of FIG. 2 mounted within a drain opening in a sink basin and coupled with a flanged drain housing and drain basket in accordance with example embodiments of the present disclosure.
Figure 6:
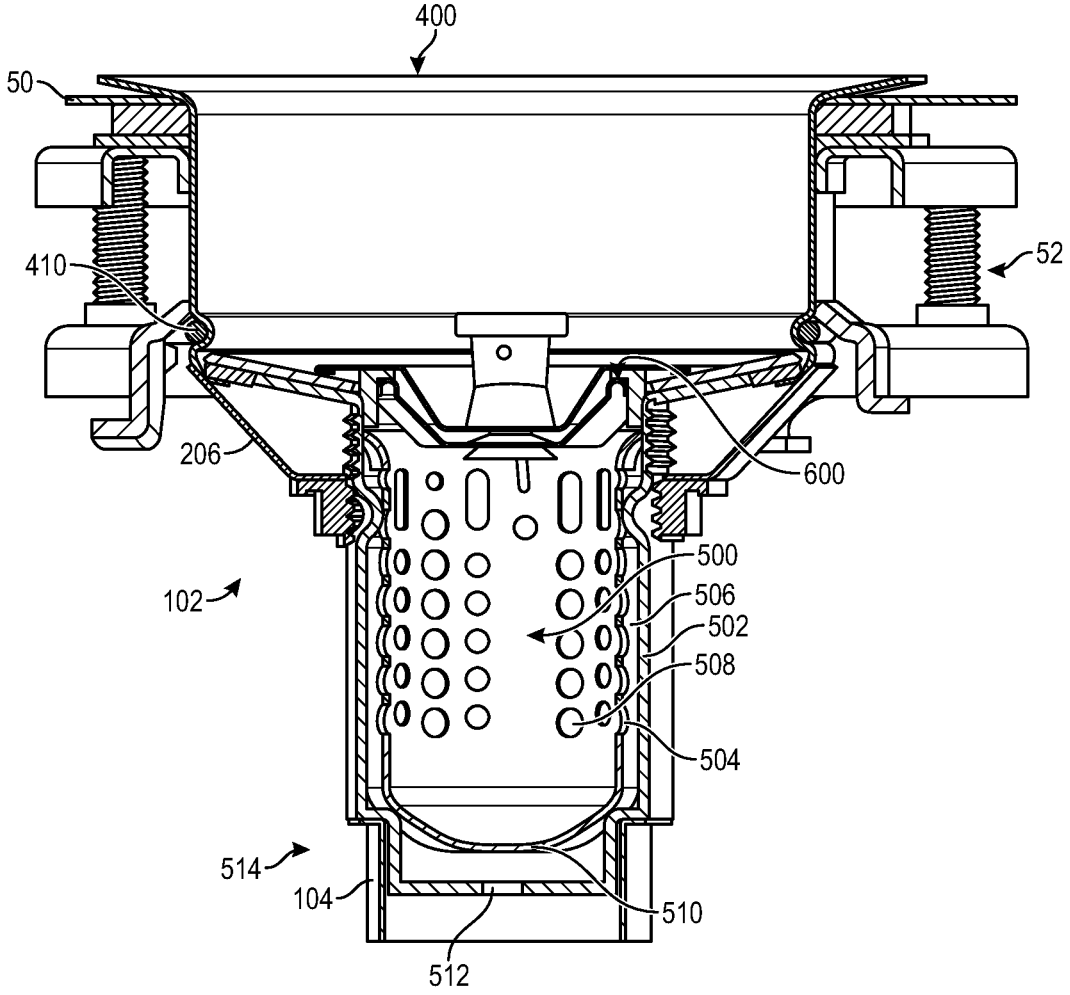
FIG. 6 is a cross-sectional view of the drain adapter of FIG. 5 with an inserted drain plug in accordance with example embodiments of the present disclosure.
Figure 7:
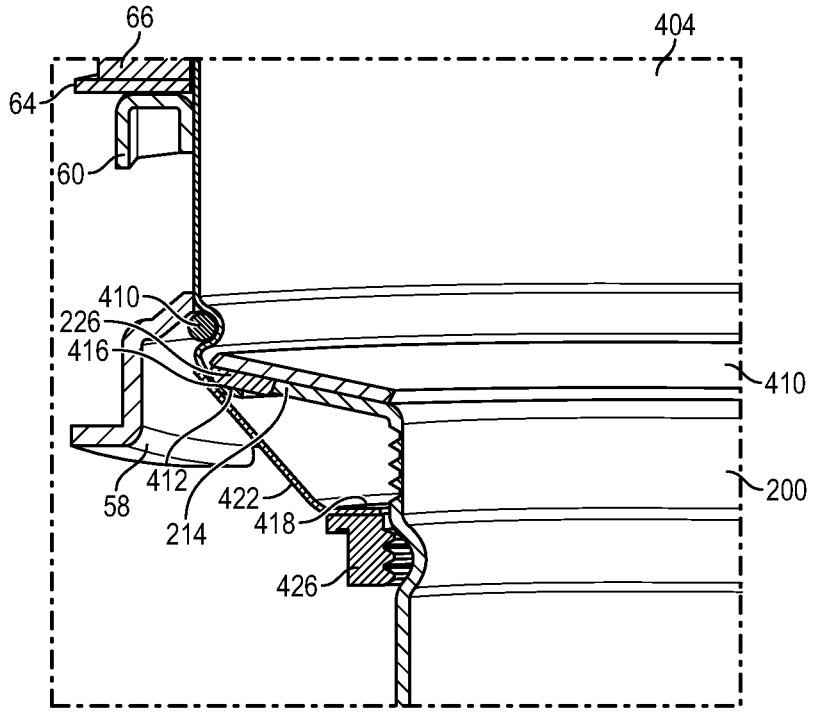
FIG. 7 is a partial cross-sectional view showing an interface between the drain adapter of FIG. 2 and a flanged drain housing in accordance with example embodiments of the present disclosure.

Portions of the drain shield 206 can interact with the flanged drain housing 400 to influence the interaction between the lip 412 and the collar 204. For example, the drain shield 206 can include a base 418 defining an opening 420 that surrounds the exterior of the drain body 200 when the drain shield 206 is positioned about the drain body 200. The base 418 transitions to angled sidewalls 422 that form the interior surface 228 of the drain shield 206. The sidewalls 422 contact the housing body 404 at an end 424 of the sidewalls 422 distal the base 418, where such contact can push the bottom portion 414 of the housing body 404 into contact with the collar 204. For example, the drain adapter 102 can include an internally threaded fastener 426 (e.g., a hex nut) configured to interact with an external threading 428 on the drain body to vertically push the base 418 of the drain shield 206 upwards, causing the sidewalls 422 to contact or tighten contact with the bottom portion 414 of the housing body 404. In implementations, the interior surface 228 of the drain shield 206 at the end 424 of the sidewalls 422 physically contacts the bottom portion 414 of the housing body 404 to push the lip 412 against the collar seal 226. The contact between the sidewalls 422 and the bottom portion 414 of the housing body 404 strengthen the interaction between the lip 412 and the collar 204 to provide a tight seal against water or other materials. As shown in FIGS. 5 and 6, the drain adapter 102 can couple with the flanged drain housing 400 without requiring removal of the garbage disposal mount 52. In implementations, the sidewalls 422 form a frustoconical shape, however the present disclosure is not limited to such structural shape of the drain shield 206.

The drain body 200 can support a drain basket to separate solid particulates, such as food waste, from water that is transferred from the sink basin 50 through the flanged drain housing 400 and into the interior 202 of the drain body 200. For example, the drain body is shown in FIGS. 5 and 6 as including a drain basket 500 in the interior 202 of the drain body 200. The drain body 200 can include sidewalls 502 that are spaced apart from sidewalls 504 of the drain basket 500 to provide a gap 506 through which water can pass while being separated from the solid waste. For example, the drain basket 500 can include a plurality of openings 508 in the sidewalls 504 to allow water to exit from the drain basket 500 and into the gap 506, while retaining solid waste too large to pass through the openings 508. Alternatively or additionally, the drain basket 500 can include openings 508 in a base 510 of the drain basket 500 coupled to the sidewalls 504. The separated water can pass through the drain body 200 for removal via one or more openings 512 in a bottom portion 514 of the drain body 200 for subsequent passage to the drainpipe 104 coupled to the drain body 200. In implementations, the drain body 200 defines a recessed portion 300 that interacts with the sidewalls 504 of the drain basket 500 to position the drain basket 500 within the interior 202 to form the gap 506 around the perimeter of the interior 202

(e.g., to center the drain basket 500 within the drain body 200 while providing a sufficient gap 506 for the passage of water therethrough).

The drain adapter 102 can support a plug to prevent the flow of water through the drain body 200, such as when a user desires to fill the sink basin 50 with water. For example, FIG. 6 shows the collar 204 supporting a plug 600 within the entry region 220 of the interior 202.

Figure 8:
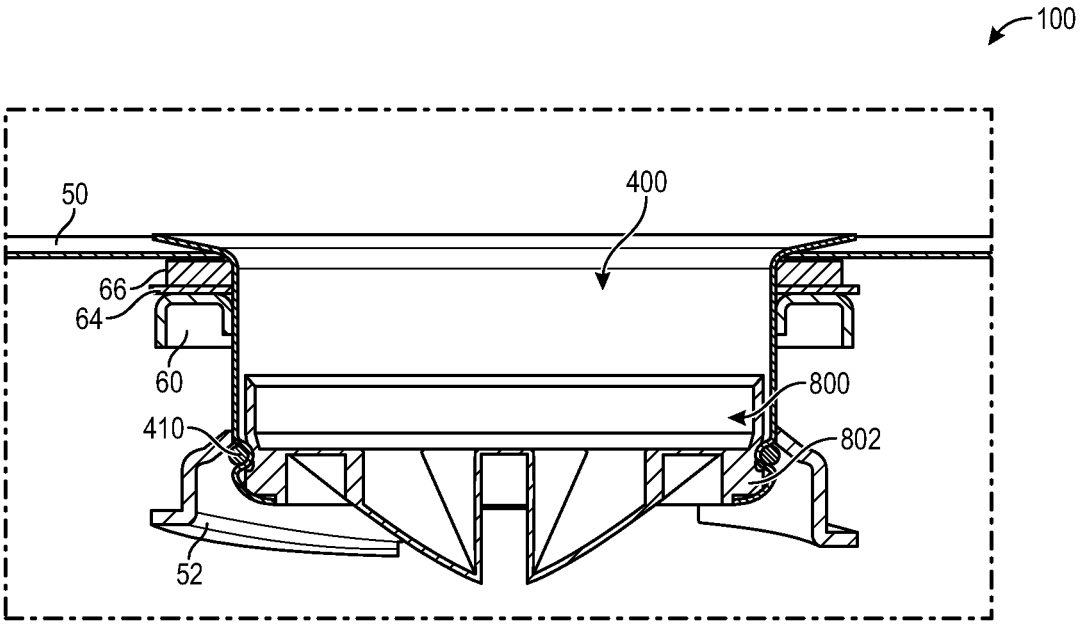
FIG. 8 is a cross-sectional view of the drain assembly of FIG. 1B in accordance with example embodiments of the present disclosure.

Referring to FIG. 8, the drain assembly 100 is shown with the drain adapter 102 interchanged with a splash guard 800 for preparation for installation of a garbage disposal unit (not shown). For instance, the splash guard 800 is shown introduced into the flanged drain housing 400 with a protrusion 802 resting against the lip 412 and with sidewalls 804 pressed against the interior of the recessed portion 408. The garbage disposal mount 52 is shown supported by the mounting ring 410, with the bottom mounting bracket 58 in contact with the mounting ring 410. The bottom mounting bracket 58 defines one or more ledges 800 on which a frame of the garbage disposal unit can hang to hold the garbage disposal unit in place relative to the flanged drain housing 400 and the sink basin 50. The splash guard 800 and the drain adapter 102 can be interchangeably coupled with the flanged drain housing 400 without requiring removal of the garbage disposal mount 52. In implementations, the drain assembly 100 can be included as a kit including each of the drain adapter 102 and the splash guard 800 to permit a user to interchangeably install the drain adapter 102 or the splash guard dependent on whether a garbage disposal unit is desired to be utilized with the sink basin 50.

CONCLUSION

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

The invention claimed is:

1. A sink basin drain assembly, comprising:

a flanged drain housing configured to couple to a drain aperture in a sink basin, the flanged drain housing including a housing body configured to fit within the drain aperture, the housing body defining an interior through which water from the sink basin can pass, a flange extending outwardly from a top portion of the housing body to interface with an upper surface of the sink basin adjacent the drain aperture, and a lip extending inwardly from a bottom portion of the housing body; and a drain adapter configured to interchangeably couple with the flanged drain housing, the drain adapter including a drain body defining an interior through which water from the flanged drain housing can pass, a collar extending outwardly from the drain body and terminating at an exterior edge, the collar tapering from the exterior edge to an aperture fluidic ally coupled with the interior of the drain body, the exterior edge configured to couple with the lip of the flanged drain housing, the collar including a collar seal configured to abut an upper surface of the lip to prevent the passage of water between the collar and the flanged drain housing, and a drain shield including a base and sidewalls extending upwardly from the base, the base defining an opening configured to surround an exterior of the drain body, the sidewalls configured to interface with the bottom portion of the flanged drain housing to push the lip against the collar seal.

2. The sink basin drain assembly of claim 1, wherein the collar includes a top portion forming the exterior edge and defining the aperture in the collar, and wherein the collar includes a bottom portion supporting at the top portion, the bottom portion extending outwardly from the drain body and terminating at a second exterior edge, the exterior edge extending beyond the second exterior edge.

3. The sink basin drain assembly of claim 2, wherein the collar defines a gap adjacent the second exterior edge beneath the top portion.

4. The sink basin drain assembly of claim 3, wherein at least a portion of the collar seal is positioned in the gap.

5. The sink basin drain assembly of claim 1, wherein the drain body defines an external threading positioned beneath the collar.

6. The sink basin drain assembly of claim 5, further comprising an internally threaded fastener configured to interface with the external threading of the drain body, the internally threaded fastener configured to raise the base of the drain shield to bias the sidewalls against the bottom portion of the flanged drain housing adjacent the lip.

7. The sink basin drain assembly of claim 1, wherein the housing body of the flanged drain housing defines a recessed portion about a perimeter of the housing body, the recessed portion configured to house a mounting ring configured to support a garbage disposal mount.

8. The sink basin drain assembly of claim 7, wherein the flanged drain housing is configured to interchangeably couple with each of the drain adapter and a garbage disposal splash guard without removal of the garbage disposal mount.

9. A sink basin drain assembly, comprising:

a drain body defining an interior through which water from a sink basin can pass;

a collar extending outwardly from the drain body and terminating at an exterior edge and tapering from the exterior edge to an aperture fluidically coupled with the interior of the drain body, the exterior edge configured to couple with an inwardly extending interior lip on a bottom portion of a flanged drain housing configured to fit within a drain aperture in the sink basin, the collar including a collar seal configured to abut an upper surface of the lip to prevent the passage of water between the collar and the flanged drain housing; and a drain shield including a base and sidewalls extending upwardly from the base, the base defining an opening configured to surround an exterior of the drain body, the sidewalls configured to interface with the bottom portion of the flanged drain housing to push the lip against the collar seal.

10. The sink basin drain assembly of claim 9, wherein the collar includes a top portion forming the exterior edge and defining the aperture in the collar, and wherein the collar includes a bottom portion supporting at the top portion, the bottom portion extending outwardly from the drain body and terminating at a second exterior edge, the exterior edge extending beyond the second exterior edge.

11. The sink basin drain assembly of claim 10, wherein the collar defines a gap adjacent the second exterior edge beneath the top portion.

12. The sink basin drain assembly of claim 11, wherein at least a portion of the collar seal is positioned in the gap.

13. The sink basin drain assembly of claim 9, wherein the drain body defines an external threading positioned beneath the collar.

14. The sink basin drain assembly of claim 13, further comprising an internally threaded fastener configured to interface with the external threading of the drain body, the internally threaded fastener configured to raise the base of the drain shield to bias the sidewalls against the bottom portion of the flanged drain housing adjacent the lip.

15. The sink basin drain assembly of claim 9, wherein the drain body is configured to support a drain basket within at least a portion of the interior, the drain basket including sidewalls having one or more apertures to permit water to flow therethrough, and wherein the drain body includes sidewalls spaced apart from the sidewalls of the drain basket to form a gap through which water from the drain basket can pass.

16. The sink basin drain assembly of claim 15, wherein the drain body defines a recessed portion configured to interface with the sidewalls of the drain basket to position the drain basket within the interior and form the gap between the sidewalls of the drain basket and the sidewalls of the drain body.

17. A sink basin drain assembly, comprising:

a sink basin having a base defining a drain aperture to drain water from the sink basin;

a flanged drain housing coupled to the sink basin through the drain aperture, the flanged drain housing including a housing body configured to fit within the drain aperture, the housing body defining an interior through which water from the sink basin can pass, a flange extending outwardly from a top portion of the housing body to interface with an upper surface of the sink basin adjacent the drain aperture, and a lip extending inwardly from a bottom portion of the housing body; and a drain adapter configured to interchangeably couple with the flanged drain housing, the drain adapter including a drain body defining an interior through which water from the flanged drain housing can pass, a collar extending outwardly from the drain body and terminating at an exterior edge, the collar tapering from the exterior edge to an aperture fluidically coupled with the interior of the drain body, the exterior edge configured to couple with the lip of the flanged drain housing, the collar including a collar seal configured to abut an upper surface of the lip to prevent the passage of water between the collar and the flanged drain housing, and a drain shield including a base and sidewalls extending upwardly from the base, the base defining an opening configured to surround an exterior of the drain body, the sidewalls configured to interface with the bottom portion of the flanged drain housing to push the lip against the collar seal.

18. The sink basin drain assembly of claim 17, wherein the collar includes a top portion forming the exterior edge and defining the aperture in the collar, the collar including a bottom portion supporting at the top portion, the bottom portion extending outwardly from the drain body and terminating at a second exterior edge, the exterior edge extending beyond the second exterior edge, and wherein the collar defines a gap adjacent the second exterior edge beneath the top portion with at least a portion of the collar seal being positioned in the gap.

19. The sink basin drain assembly of claim 17, wherein the drain body defines an external threading positioned beneath the collar.

20. The sink basin drain assembly of claim 19, further comprising an internally threaded fastener configured to interface with the external threading of the drain body, the internally threaded fastener configured to raise the base of the drain shield to bias the sidewalls against the bottom portion of the flanged drain housing adjacent the lip.

* * * * *